US005351834A

United States Patent [19]

Duss

[11] Patent Number: 5,351,834

[45] Date of Patent: Oct. 4, 1994

[54] MONITORING OF PRINTED SHEETS

[75] Inventor: Hanspeter Duss, Gretzenbach, Switzerland

[73] Assignee: Grapha-Holding AG, Hergiswil, Switzerland

[21] Appl. No.: 949,779

[22] Filed: Sep. 22, 1992

[30] Foreign Application Priority Data

Sep. 26, 1991 [CH] Switzerland ..... 2859/91-1

[51] Int. Cl.[5] ..... B07C 5/00; G06K 9/68

[52] U.S. Cl. ..... 209/576; 356/392; 382/8; 382/34

[58] Field of Search ..... 382/8, 9, 34; 356/388, 356/392, 393, 394, 397; 209/534, 552, 576, 577, 587

[56] References Cited

U.S. PATENT DOCUMENTS

| | | | |
|---|---|---|---|
| 4,685,139 | 8/1987 | Masuda et al. | 382/34 X |
| 4,904,875 | 2/1990 | Shankel | 209/576 X |
| 5,058,175 | 10/1991 | Aso | 382/34 X |
| 5,060,281 | 10/1991 | Ohnishi | 382/34 |
| 5,065,440 | 11/1991 | Yoshida et al. | 382/34 X |
| 5,121,444 | 6/1992 | Takizawa et al. | 382/34 X |
| 5,181,257 | 1/1993 | Steiner et al. | 382/8 X |

FOREIGN PATENT DOCUMENTS

| | | | |
|---|---|---|---|
| 3806125 | 9/1989 | Fed. Rep. of Germany . | |
| 0277891 | 3/1990 | Japan | 382/34 |

*Primary Examiner*—D. Glenn Dayoan
*Assistant Examiner*—Tuan N. Nguyen
*Attorney, Agent, or Firm*—Darby & Darby

[57] ABSTRACT

A printed sheet constituting a reference is scanned to form an image of a predetermined part of the sheet, and this reference image is stored in a microprocessor. Additional printed sheets which are to undergo further processing are subsequently similarly scanned to form images of predetermined parts thereof which, as regards position, correspond at least approximately to the predetermined part of the reference sheet. The predetermined part of the reference sheet may be larger than the predetermined parts of the additional sheets or vice versa so that the reference image is larger than the other images or vice versa. The microprocessor compares the image of each additional sheet with that of the reference sheet. In comparing two images, the microprocessor searches the larger image to determine the relative position in which the images would be most closely matched if superimposed on one another. The microprocessor then generates a signal representative of the difference between the two images in such relative position. The magnitude of the signal indicates whether an additional sheet is identical to the reference sheet and should be further processed or whether the additional sheet does not conform to the reference sheet and should be removed.

17 Claims, 2 Drawing Sheets

MONITORING OF PRINTED SHEETS

BACKGROUND OF THE INVENTION

The invention relates generally to the monitoring of articles.

More particularly, the invention relates to the monitoring of printed sheets or other printed products which are to undergo processing.

A known method of monitoring printed sheets compares a printed sheet which is to be passed through processing stations with a reference sheet. This method is mainly used in gathering machines having magazines for stacks of sheets or in other machines of similar function.

When a magazine in a gathering machine is filled, it can happen that the printed sheets are placed in the wrong magazine or are placed in the proper magazine in the wrong position. The German Offenlegungsschrift 38 06 125 overcomes this difficulty by conveying a sheet which is held in position on the feeding drum of the gathering machine past a conventional optoelectric sensor. After the first properly positioned sheet has been engaged by the feeding drum and the latter has been rotated through a predetermined angle, the brightness of a light spot on the sheet is measured within a scanning field of like color and the resulting luminosity stored as a reference value. The luminosities of the following sheets are likewise measured at the predetermined angle of rotation of the feeding drum and, when a deviation from the reference value occurs, a control pulse is generated to stop the gathering machine or produce a signal.

A sheet is considered to be properly positioned on the feeding drum as long as its position is within a certain tolerance range. Therefore, the scanning range must be as large as the tolerance range. If these ranges do not coincide, properly positioned sheets can also lead to so-called "stoppers".

It nevertheless remains possible to check a printed sheet for identity with a reference sheet even when the scanning range which can be established within the printed area of the reference sheet is smaller than the position tolerance range, and even when the position of the sheet to be checked deviates slightly from that of the reference sheet so that an error signal is generated. However, in the extreme, the known method then requires, aside from a determination of the color of a characteristic region of a printed sheet, a determination of the position of a single line along a single direction. In other words, this situation can require the detection of a single point or a single line. Since such detection is affected by the accuracy of the angle of rotation of the feeding drum relative to the position of the sensor, this method is troublesome and unreliable.

SUMMARY OF THE INVENTION

It is an object of the invention to provide a method which allows monitoring of articles to be performed reliably.

Another object of the invention is to provide a method which makes it possible to reliably compare two articles with each other.

An additional object of the invention is to provide an apparatus which is capable of monitoring articles reliably.

A further object of the invention is to provide an apparatus which can make a reliable comparison of two articles.

The preceding objects, as well as others which will become as the description proceeds, are achieved by the invention.

One aspect of the invention resides in a method of processing articles, particularly printed articles such as printed sheets. The method comprises the steps of sensing or scanning a first article to form a first image; sensing or scanning a second article to form a second image; determining the relative position in which the images would be most closely matched if superimposed on one another; calculating a value which represents a difference between the images in such relative position; and generating a control signal using the calculated value. The first image preferably has a position which corresponds, at least approximately, to that of the second image.

The method of the invention can be employed to check whether two articles are identical. For example, one of the first and second articles can constitute a reference against which the other of these articles is compared. The method of the invention can also be employed to monitor the position and/or the quality of an article.

It is assumed below that one of the articles constitutes a reference and such article will be referred to as a reference article. The other article will be referred to as a test article for the sake of simplicity. If acceptable, the test article can be advanced through one or more processing stations for additional treatment following the respective sensing step.

The method can further comprise the steps of initiating predetermined procedures for the test article, and changing or interrupting the procedures in response to the control signal.

The sensing steps may be performed optoelectrically or optoelectronically. The images produced during the sensing steps may be optical and/or electronic in nature. The image from the reference article may be larger or smaller than that from the test article.

The image from the reference article can be selected in such a manner that at least a portion of the image has high contrast. The image from the test article then preferably includes an identical portion. The portion of the reference article having high contrast may be chosen by computer.

Another aspect of the invention resides in an apparatus for processing articles, particularly printed articles such as printed sheets. The apparatus comprises a sensor for sensing or scanning the articles to form respective images, and a computer for comparing one image with another. The computer includes means for determining the relative position in which the images would be most closely matched if superimposed on one another, means for calculating a value which represents a difference between the images in such relative position, and means for generating a control signal using the calculated value.

The apparatus can further comprise means for advancing the articles along a predetermined path, and means for measuring the distance traveled by the articles. The computer may be provided with data retrieval means which communicates with the measuring means as well as the sensor.

The advancing means may include clocking means and the measuring means may be designed to measure distance in increments.

The apparatus according to the invention is particularly well-suited for carrying out the method of the invention.

The invention makes it possible to largely eliminate the errors which are especially likely to occur during the gathering of printed sheets.

The optoelectric or optoelectronic scanning of an article to form an image can be accomplished by means of a conventional sensor or scanner. In accordance with the invention, the image formed during scanning of an article need not be an image of the entire article and, unless stated otherwise, the term image as used herein will be understood to mean an image of part of an article.

As mentioned previously, the image of the reference article can be larger than that of the test articles. In carrying out the invention under this condition, an image of a reference article is formed and then stored for comparison with the images of test articles which are to undergo further processing. To perform a comparison, a portion of a test article is scanned in the same manner as the reference article. This portion, which preferably does not lie at an edge, is located within a measuring window or sight corresponding to the scanned part of the reference article.

The stored image of the reference article, including shifted or offset sections of the stored image, is now searched for measurements, e.g., luminosities, which are the same as those for the image of the test article. The search is continued until a value derived by a specified analytical procedure and considered sufficient to establish identity has been found. If this or a lesser value cannot be found, the test article is considered to be improper in some fashion.

An image can take the form of a two-dimensional grid of pixels. Each pixel can, for example, represent an area of 3 mm×3 mm.

It is advantageous to divide the two-dimensional pixel grid into a plurality of subsections which do not contain too large a number of pixels and to search with each of these subsections individually. Thus, on the one hand, the reliability of the search increases with increasing number of pixels while, on the other hand, slightly rotated articles can no longer be reliably evaluated when the subsections contain too many pixels.

Articles, and particularly printed sheets, of virtually any design can be evaluated in accordance with the invention.

When a comparison yields a value for the deviation of a test article from a reference article, a processor or computer can generate a signal based on this value. Such signal can be used by a control unit which is coupled to the computer. By way of example, the control unit can issue a command to continue processing without change, or to stop or change individual processing stations or the entire apparatus.

Alternatively, the signal can be used to remove an improper test article or to eliminate a fault by replacing an improper test article with another article.

The scanning precision can be reduced by decreasing the geometric resolution and/or by decreasing the number of luminosity steps. This makes it possible to achieve optimization taking into account the economy of the apparatus.

Fundamentally, the comparison between two articles becomes more precise as the scanning accuracy and the size of the scanned region are increased. Evidently, economics should be considered but not to the extent that a reliable comparison is compromised. A scanned region having a grid dimension of 2 to 3 mm should be adequate for a grid containing several hundred pixels (image points). At least two gray stages are required for additional differentiation. Scanning can be accomplished by means of an optoelectric or optoelectronic scanner which includes a linear array of photoelectric elements. By way of example, the scanner can be mounted at the bottom of a magazine for articles to be processed and can scan the articles across a width of about 80 mm as the articles are withdrawn from the magazine.

The scanner can, for instance, consist of 32 photoelectric elements having overlapping surfaces of 5 mm×5 mm. The luminosity can be divided into 128 steps and infrared diodes can be used to illuminate the articles.

The command to scan an article may be generated by the initial motion of an article, e.g., upon withdrawal of an article from the magazine. A rotatable roller which measures the distance of travel of the articles in increments or steps can be used to transmit pulses to a control mechanism for the scanner. These pulses cause the article to be scanned at the appropriate time.

In one embodiment of the method according to the invention, an electronic image of a relatively large section of a reference article is initially produced in a processor or computer by means of a scanner. For the following test articles, only a subsection within the measuring window or sight corresponding to such section of the reference article is used. The processor then shifts the electronic image of the test article subsection over the electronic image of the reference article section until a specified, minimal match has been achieved. When this occurs, a following test article is indicated to be proper whereas otherwise such test article is indicated to be improper.

The method of the invention makes it possible to operate even though the articles in a processing station are displaced relative to one another, i.e., an offset or slight rotation of the articles in a magazine can be taken into consideration within freely selectable limits. Checking of the positions of the articles in a processing station can be used, among other things, to monitor the quality of a fold.

Regarding the control procedure, a starting device or initiator sends a start pulse (N1 step) to the scanner control mechanism immediately after withdrawal of a test article from the magazine has begun. The control mechanism, in turn, initiates the scanning of a subsection of the test article by means of the scanner. With each step or increment of the incremental distance measuring roller, lines of the subsection are read. In the processor, the measurements from these lines are compared with one measurement, and preferably a plurality of measurements, previously read in from a section of the reference article encompassing the test article subsection. The evaluation of a comparison is completed and the measures to be taken determined before the next N1 step begins.

Fundamentally, the analysis of the results of the scanning operation can be considered to be divided into a recording and calibrating procedure and an operating procedure. When the scanner control mechanism receives a recording and calibrating command, scanning of the reference article is initiated at a distance from the leading end thereof which is sufficient to permit alignment of the measuring window and the preselected reference article section to be scanned. One or more subsections are then designated within this preselected section in such a manner as to include areas of high contrast. Each subsection may, for example, have a size equivalent to 16 pixels × 16 pixels, i.e., a size of about 40 mm × 40 mm. The subsections designated in this manner are used in the comparison with the test articles to be processed. The tolerance range within which a deviation of the minimum comparative value is still acceptable can be subsequently determined from the characteristics of the stored image or images.

To increase the reliability of the comparative value, several articles can be considered in establishing the recording and calibrating value.

In the actual operating phase for a test article, the scanner generates two-dimensional pixel grids for use in the comparison. A search is carried out for pixel grid subsections of the preselected reference article section and a value representative of the degree of matching is calculated by summing the differences in the luminosities. Under the best circumstances, a precise match between the reference article and the test article can be established by scanning a single grid with few pixels. Under the worst circumstances, none of the scanned areas or subsections of the test article completely match the subsections of the reference article.

An improvement in the comparative values can be achieved by increasing the resolution of the scanned areas. This decreases the susceptibility to disturbances when scanning a subsection of an article.

Upon completion of a comparison, the result is transmitted to a digital output of the master control unit as a signal representing acceptance or rejection. The processing of the test article can then be influenced accordingly.

The novel features which are considered as characteristic of the invention are set forth in particular in the appended claims. The improved method, as well as the construction and mode of operation of the improved apparatus, together with additional features and advantages of the method and apparatus, will, however, be best understood upon perusal of the following detailed description of certain presently preferred embodiments when read in conjunction with the accompanying drawings.

DESCRIPTION OF THE PREFERRED EMBODIMENTS

Figure 1:
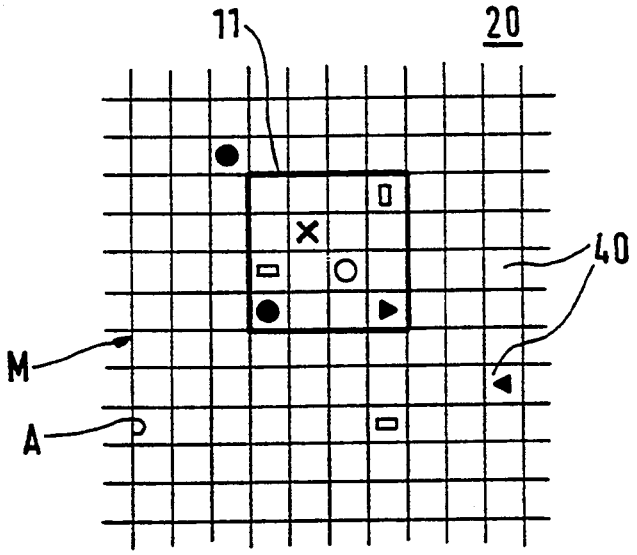
FIG. 1 illustrates a measuring window in register with a preselected, printed reference sheet section to be scanned.

FIG. 1 shows a measuring window M which is in register with and frames a preselected section A of a printed reference sheet 20. A subsection 11 which consists of sixteen pixels 40 and is in the form of a square having four pixels 40 on a side is shown inside the measuring window M and preselected section A. The preselected section A is scanned in order to form an electronic image of the preselected section A and subsection 11.

Subsections of printed test sheets which follow the reference sheet 20 are electronically imaged within the subsection 11. The test sheet subsections are thereupon compared with the subsection 11 of the preselected section A.

Figure 2:
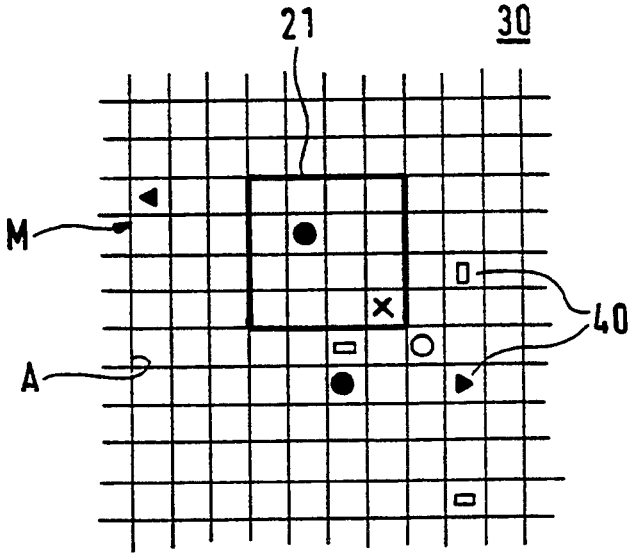
FIG. 2 illustrates a section of a test sheet in register with the window, the test sheet being shifted relative to the reference sheet along two coordinates.

FIG. 2 illustrates a printed test sheet 30 which is to undergo treatment in one or more processing stations. The test sheet 30 is offset with respect to the reference sheet 20 horizontally and vertically but is clearly identical to the reference sheet 20. The test sheet 30 has a subsection 21 which has the same position relative to the measuring window M as the subsection 11 of the reference sheet 20. The subsection 21 is scanned so as to form an electronic image thereof.

A processor or computer searches the image of the preselected section A of the reference sheet 20 in order to find that subsection of the reference sheet 20 which most closely matches the subsection 21 of the printed test sheet 30. The search includes locations which are shifted with respect to the measuring window M.

Figure 3:
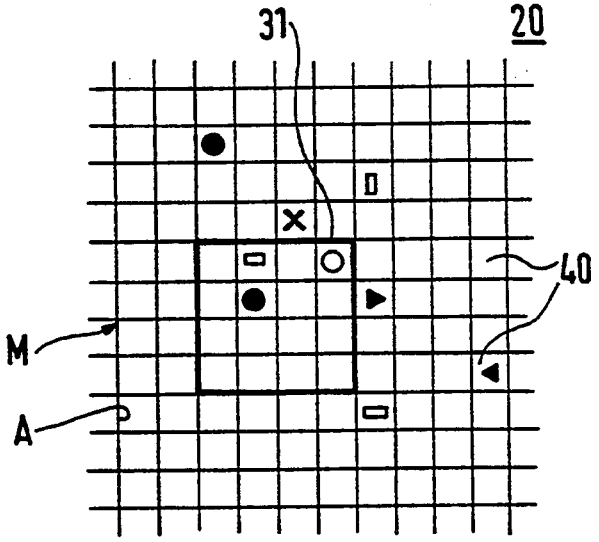
FIGS. 3, 4 and 5 illustrate one possible search sequence within the preselected section of the reference sheet.
Figure 4:
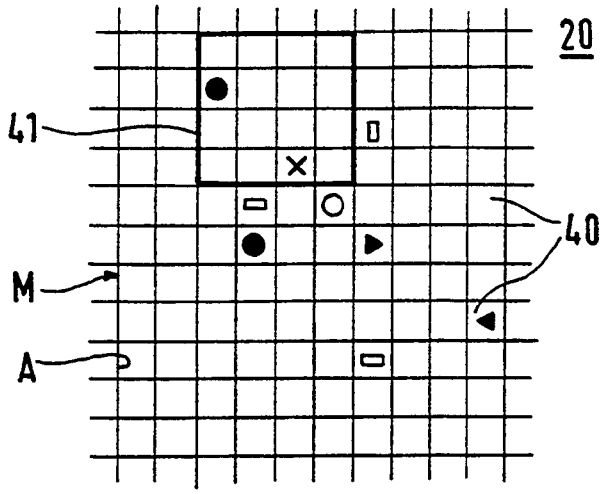
Figure 5:
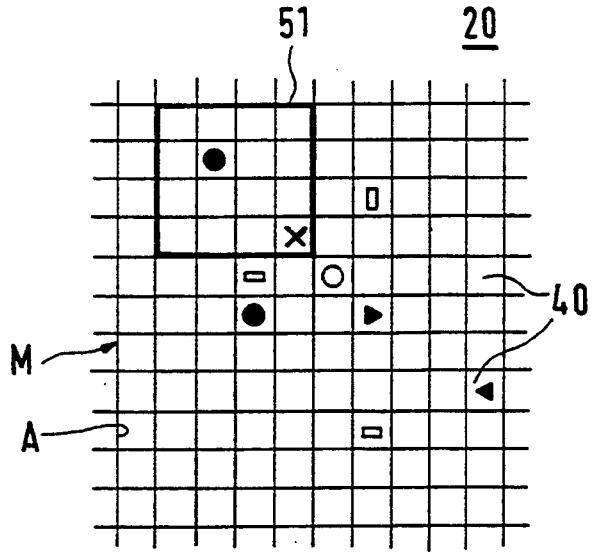

One possible search sequence using the image of the preselected section A of the reference sheet 20 and the image of the subsection 21 of the test sheet 30 is shown in FIGS. 3, 4 and 5.

In FIG. 3, the processor compares the subsection 21 of the test sheet 30 with a second subsection 31 of the printed reference sheet 20. An obvious difference is found.

Referring to FIG. 4, the processor compares the subsection 21 of the test sheet 30 with another subsection 41 of the reference sheet 20. Again, a clear difference exists.

However, when the processor subsequently compares the subsection 21 of the test sheet 30 with an additional subsection 51 of the reference sheet 20 as shown in FIG. 5, the processor determines that there is a match and signals that the test sheet 30 is identical to the reference sheet 20.

The search can proceed in steps along horizontal and vertical coordinates or in accordance with statistically optimized rules.

When an improper test sheet is present, the search is terminated upon a determination that no subsection of the preselected section A of the reference sheet 20 is closely enough matched to the subsection of the test sheet.

According to another embodiment of the invention, the processor forms and stores an electronic image of only the subsection 11 of the printed reference sheet 20. In this case, each subsequent printed test sheet is scanned over a preselected section, such as the preselected section A, defined by the measuring window M. The image of the preselected section of a test sheet is then searched for that subsection which matches the stored subsection 11 of the reference sheet 20.

A comparative value representing the degree of matching of two subsections is calculated by summing the differences in luminosity of corresponding pixels of the subsections. The value obtained upon comparing two subsections decreases as the deviation which would exist if the subsections were superimposed decreases.

Calculation of the comparative value advantageously involves intermediate steps such as, for instance, filtering of the input data, interpolation of the luminosities of the pixels and/or equating of the average luminosity of the subsection 21 of the test sheet 30 to that of the reference sheet 20. The smaller the minimum comparative value, the closer the match between the reference sheet 20 and the possibly shifted test sheet 30.

Figure 6:
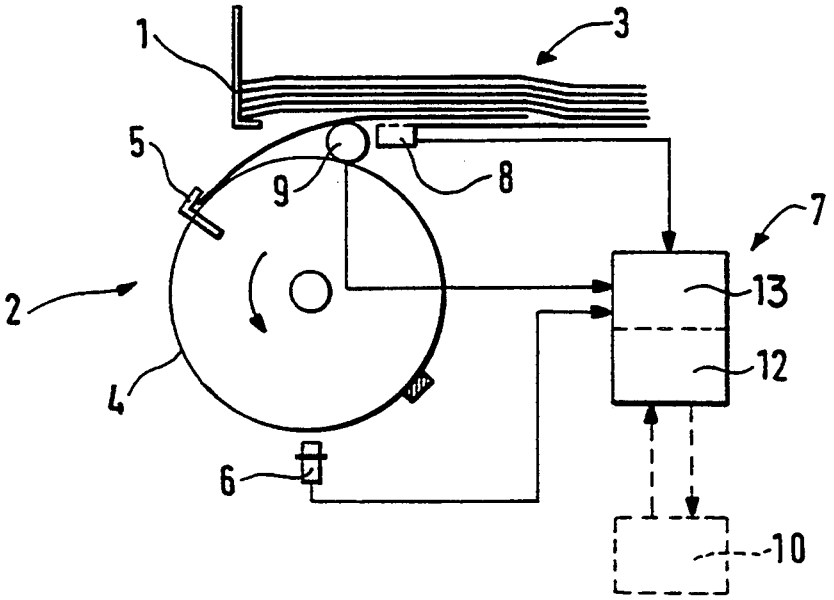
FIG. 6 shows an apparatus in accordance with the invention which can be used for the method of the invention.

FIG. 6 shows an apparatus in accordance with the invention which is particularly well-suited for carrying out the method of the invention. The apparatus may, for example, constitute part of a gathering machine for printed sheets.

In FIG. 6, the reference numeral 2 identifies a feeder having a magazine 1 which accommodates a stack 3 of printed sheets. A withdrawal drum 4 successively removes the lowermost of the sheets from the magazine 1 and advances the sheets along a predetermined path for further processing in one or more processing stations. The withdrawal drum 4 is provided with a gripping device 5 for the sheets.

The withdrawal drum 4 is further provided with an actuating element which cooperates with a starting device or initiator 6. The actuating element causes the starting device 6 to emit a start pulse and the arrangement is such that the starting device 6 generates a pulse before the withdrawal drum 4 begins to remove a sheet from the magazine 1.

The starting device 6 is connected to a data receiving unit 13 constituting part of a microprocessor 7. The data receiving unit, in turn, is connected to a scanner 8 which is mounted below the stack of sheets in the magazine 1 upstream of the beginning of the path of travel of the sheets. The data receiving unit 13 is further connected to a distance measuring roller 9 which is designed to measure the distance of travel of the sheets in steps or increments. The data receiving unit 13 is also connected to an analyzing unit 12 constituting part of the microprocessor 7. The analyzing unit 12 is connected to a master control unit 10.

In operation, the master control unit 10 generates a calibrating command for the purpose of performing a calibration with a reference sheet. Such a sheet is then withdrawn from the magazine 1 by the withdrawal drum 4 of the feeder 2. As the reference sheet is withdrawn from the magazine 1, the roller 9 measures the distance traveled by the reference sheet in steps, e.g., one step equals the length of one pixel. A signal is transmitted to the microprocessor 7 for each step, and the microprocessor 7 causes one image line (pixel line) to be scanned per step.

Once a preselected section of the reference sheet has been scanned and an image of the preselected section formed, at least one subsection of the preselected section is defined. Furthermore, the maximum value which is still indicative of a match between a subsection of the reference sheet and a subsection of a test sheet is established for each subsection of the reference sheet.

The apparatus is now prepared to check test sheets for uniformity. Thus, the microprocessor 7 can now compare the images of the pixel grids obtained upon the scanning of test sheets with the stored image or images of the pixel grids formed during scanning of the reference sheet. Following a comparison, the microprocessor 7 sends a control command to the master control unit 10. The nature of the control command depends upon the magnitude of the comparative value resulting from the comparison.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An apparatus for checking printed articles for mutual identity and proper orientation while allowing for relative positional displacement within predetermined limits, said apparatus comprising:

(a) means for advancing said printed articles along a predetermined path;

(b) a sensor, having means for optically sensing a preselected reference section of a printed article, to produce an optical image regardless of the degree of luminous density of said printed article, and for optically sensing a test section of each of said printed articles to be checked in an operating mode, to produce an optical image regardless of the degree of luminous density of said printed articles, said image of one of said reference section and said test section having a larger cross-sectional area than the image of the other one of said reference section and said test section;

(c) means for storing the result of said optical sensing;

(d) means for comparing the stored results by shifting said smaller cross-sectional area image in superposition with respect to said larger cross-sectional area image;

(e) means for calculating a value to represent a difference between said images in each of said shifted positions; and (f) means for generating a control signal, indicative of a mismatch between said reference and said test article, when said value is insufficient to establish identity between said reference and said test article.

2. The apparatus of claim 1 further comprising a computer having data retrieval means which communicates with said sensor; and further comprising means for advancing the articles along a predetermined path, and means for measuring the distance traveled by the articles, said data retrieval means being in communication with said measuring means.

3. The apparatus of claim 2, wherein said measuring means is designed to measure distance in increments.

4. The apparatus of claim 2, wherein said advancing means comprises clocking means.

5. A method of checking printed articles for mutual identity and proper orientation while allowing for relative positional displacement within predetermined limits, said method comprising the steps of:

(a) advancing said printed articles along a predetermined path;

(b) optically sensing a preselected reference section of a printed article, to produce an optical image regardless of the degree of luminous density of said printed article, and storing the result of said optical sensing;

(c) optically sensing a test section of each of said printed articles to be checked in an operating mode, to produce an optical image regardless of the degree of luminous density of said printed articles, and storing the result of said optical sensing, said image of one of said reference section and said test section having a larger cross-sectional area than the image of the other one of said reference section and said test section, said section having a larger cross-sectional area image being positioned to encompass said other smaller cross-sectional area image;

(d) comparing the stored result, of sensing said reference section, with the result, of sensing said current test section, by shifting said smaller cross-sectional section area image in superposition with respect to said larger cross-sectional area image and calculating a value to represent a difference between said images in each of said shifted positions; and (e) generating a control signal, indicative of a mismatch between said reference and said test article, when said value is insufficient to establish identity between said reference and said test article.

6. The method of claim 5, further comprising the step of initiating predetermined procedures for one of said reference and test articles, and changing said procedures in response to said signal.

7. The method of claim 5, further comprising the step of initiating predetermined procedures for one of said reference and test articles, and interrupting said procedures in response to said signal.

8. The method of claim 5, wherein at least one of said images is an optical image.

9. The method of claim 5, wherein at least one of said images is an electronic image.

10. The method of claim 5, wherein said images comprise two-dimensional grids of pixels.

11. The method of claim 5, further comprising the step of removing one of said reference and test articles in response to said signal.

12. The method of claim 5, further comprising the step of replacing one of said reference test articles in response to said signal.

13. The method of claim 5, further comprising the step of monitoring the position of one of said reference and test articles by means of said signal.

14. The method of claim 5, further comprising the step of monitoring the quality of one of said reference and test articles by means of said signal.

15. The method of claim 5, further comprising the step of limiting the precision of the sensing steps.

16. The method of claim 5, wherein the sensing steps are performed in such a manner that each of said images includes a portion having high contrast.

17. The method of claim 16, wherein said reference section is selected by computer.

* * * * *